US010052653B2

(12) United States Patent
Clemens

(10) Patent No.: US 10,052,653 B2
(45) Date of Patent: Aug. 21, 2018

(54) SLEEVE, DISPENSING APPARATUS COMPRISING THE SLEEVE AND METHOD

(71) Applicant: SULZER MIXPAC AG, Haag (CH)

(72) Inventor: Victor Clemens, Bregenz (AT)

(73) Assignee: SULZER MIXPAC AG, Haag (CH)

( * ) Notice: Subject to any disclaimer, the term of this patent is extended or adjusted under 35 U.S.C. 154(b) by 38 days.

(21) Appl. No.: 15/030,456

(22) PCT Filed: Oct. 9, 2014

(86) PCT No.: PCT/EP2014/071608
§ 371 (c)(1),
(2) Date: Apr. 19, 2016

(87) PCT Pub. No.: WO2015/062831
PCT Pub. Date: May 7, 2015

(65) Prior Publication Data

US 2016/0271642 A1 Sep. 22, 2016

(30) Foreign Application Priority Data

Oct. 29, 2013 (EP) ..... 13190743

(51) Int. Cl.
*B05C 17/005* (2006.01)
*B05C 17/01* (2006.01)

(52) U.S. Cl.
CPC .. *B05C 17/00583* (2013.01); *B05C 17/00553* (2013.01); *B05C 17/01* (2013.01)

(58) Field of Classification Search
CPC ..... B05C 17/00553; B05C 17/00583; B05C 17/005; B05C 17/01; B65D 83/0072
USPC ..... 222/325, 326
See application file for complete search history.

(56) References Cited

U.S. PATENT DOCUMENTS 3,204,828 A 9/1965 Paulsen
3,288,333 A 11/1966 Valk, Jr.
4,020,978 A * 5/1977 Szczepanski ..... B05B 11/046 222/209
4,429,811 A * 2/1984 Bakeman ..... C12H 1/22 222/159
5,044,803 A 9/1991 Kurosawa et al.
(Continued)

FOREIGN PATENT DOCUMENTS

CN 86106029 A 6/1987
CN 1075689 A 9/1993
(Continued)

OTHER PUBLICATIONS

International Preliminary Report on Patentability and Written Opinion dated May 3, 2016 in PCT/EP2014/071608, filed Oct. 9, 2014.
(Continued)

*Primary Examiner* — J. Casimer Jacyna
(74) *Attorney, Agent, or Firm* — Global IP Counselors, LLP

(57) ABSTRACT

A dispensing apparatus is suitable for the reception of a collapsible cartridge including a dispensable medium. The cartridge and the sleeve can be arranged with respect to one another such that the sleeve can support a cartridge wall of the cartridge in at least one section thereof during dispensing of the medium. A length of the sleeve can be changed substantially parallel to a dispensing direction.

20 Claims, 5 Drawing Sheets

(56) References Cited

U.S. PATENT DOCUMENTS

| | | | | |
|---|---|---|---|---|
| 5,405,054 | A * | 4/1995 | Thomas | A23G 3/28 222/105 |
| 5,494,190 | A | 2/1996 | Boettcher | |
| 5,535,924 | A | 7/1996 | Nilsson et al. | |
| 6,472,007 | B2 | 10/2002 | Bezek et al. | |
| 6,634,524 | B1 | 10/2003 | Helmenstein | |
| 2005/0269358 | A1* | 12/2005 | Choi | B65D 35/28 222/103 |
| 2013/0026182 | A1 | 1/2013 | Habibi-Naini | |
| 2016/0243581 | A1* | 8/2016 | Clemens | B05C 17/00583 |

FOREIGN PATENT DOCUMENTS

| | | | |
|---|---|---|---|
| CN | 1171750 | A | 1/1998 |
| CN | 1501884 | A | 6/2004 |
| CN | 2657793 | Y | 11/2004 |
| CN | 1753732 | A | 3/2006 |
| DE | 19943877 | B4 | 3/2001 |
| FR | 763931 | A | 5/1934 |
| NZ | 566201 | A | 6/2009 |
| WO | 2011131483 | A1 | 10/2011 |
| WO | 2013078036 | A1 | 5/2013 |

OTHER PUBLICATIONS

Chinese Office Action and Search Report dated Feb. 2, 2018 in corresponding Chinese Application No. 201480059272.7 (with English Translation of Categories of Cited Documents).

* cited by examiner

SLEEVE, DISPENSING APPARATUS COMPRISING THE SLEEVE AND METHOD

CROSS-REFERENCE APPLICATION

This application is a U.S. National Stage Application of International Application No. PCT/EP2014/071608, filed Oct. 9, 2014, which claims priority to European Application No. 13190743.8, filed Oct. 29, 2013, the contents of each of which is hereby incorporated herein by reference.

BACKGROUND

Field of Invention

The invention relates to a sleeve, to a dispensing apparatus and to a method for dispensing a medium out of a cartridge.

Background Information

Cartridges are frequently used in an industrial setting, such as in the construction sector, for example on the construction of buildings and/or structures, as well as in the dental field, in order to store flowable substances and to dispense these as required for the respective application. Examples of such substances are caulking compounds, compounds for chemical dowels or chemical anchors, adhesives, pastes or impression compounds in the dental field. These cartridges are typically made of plastic and are produced in an injection molded process.

One differentiates between one component systems in which the material to be dispensed is only composed of one component and two-component or multi-component systems in which at least two different components are stored in separate chambers of the same cartridge or in separate cartridges, wherein the components are mixed on dispensing by a dynamic mixing apparatus or of a static mixing apparatus. An example of this is a two-component adhesive which only hardens once the two components have been mixed.

From the WO 2011/131483 A1 a cartridge capable of standing is known having at least one reception chamber for a medium to be dispensed extending in the longitudinal direction, comprising a cartridge base and comprising a cartridge wall which bound the reception chamber, wherein the cartridge is produced by means of a thermo forming process or a blow molding process and is configured collapsible in a controllable manner.

However, under some circumstances this known prior art has the effect that the cartridge can break, burst, bulge or can be inflated on a collapsing of the cartridge for a dispensing of the medium by the exerted pressure, whereby an increased residual volume can remain in the cartridges and at the same time a cleaning of the support cartridge from residue possibly becomes necessary.

SUMMARY

For this reason, it is an object of the present invention to avoid the disadvantages of the known art, in particular to thus provide a sleeve, a dispensing apparatus and a method for dispensing a medium out of the cartridge by which a breaking, a bursting or an inflating of the cartridge can be avoided as far as possible during the dispensing.

These objects are satisfied by the sleeve, the dispensing apparatus and the corresponding method in accordance with the independent claims.

The dependent claims relate to particularly advantageous embodiments of the invention.

The invention relates to a sleeve for a dispensing apparatus. The dispensing apparatus is suitable for the reception of a collapsible cartridge including a dispensable medium. The cartridge and the sleeve are arranged with respect to one another such that the sleeve can support a cartridge wall of the cartridge at least in one section thereof during a dispensing of the medium. A length of the sleeve can be changed substantially in parallel to a dispensing direction.

This configuration has the advantage that during the dispensing of the medium the sleeve can support and/or stabilize the cartridge wall substantially at a side of the dispensing direction, so that a breaking or even a bursting of the cartridge can be prevented on dispensing for a reliable dispensing of the medium. By way of the variability of the length of the sleeve it can be ensured that the sleeve does not or possibly only insignificantly influences the dispensing on a collapsing of the cartridge for dispensing the medium. Thus, a dispensing of the medium from the cartridge can take place more reliably, wherein a subsequent demand in cleaning can possibly be further minimized which makes the handling more efficient and more cost-effective. Furthermore, a reproducibility of the dispensed amount of the medium can be improved by a far reaching prevention of the inflation of the cartridge. Hereby a more reliable and more reproducible mixing result can be achieved. This is in particular advantageous on the use of frustoconical cartridges in cylindrical support cartridges.

The collapsible cartridge can have a receiving volume for the medium in the range of 10 ml to 1000 ml, preferably of 25 ml to 600 ml and particularly preferably of 50 ml to 300 ml.

The sleeve is preferably configured in such a way that a pressure exerted on the sleeve substantially perpendicular to the dispensing direction by a dispensing of the medium can be in the range of 1 bar to 30 bar, preferably of 5 to 25 bar, particularly preferably of 10 to 20 bar.

The length of the sleeve can preferably be changed in a reversible manner. This has the advantage that the sleeve can be used a multiple of times and possibly can be set to different lengths of cartridges.

A protective cover is preferably arranged at the side of the sleeve facing the cartridge. The protective cover is in particular configured as a protective film. The protective cover is arranged at least in a section between the sleeve and the cartridge on a correct use thereof.

The protective cover is preferably arranged in a removable manner.

The arrangement of the protective cover in at least one section between the sleeve and the cartridge has the advantage that the sleeve can be protected from residues of the medium to be dispensed so that this can be used reliably a multiple of times. In particular, the use of a removable protective cover has the advantage that the protective cover can possibly be exchanged as required. Hereby the lifetime of the sleeve can be improved.

Naturally, it is also plausible to fixedly connect the protective cover to the sleeve. This has the advantage that operating errors can be avoided and that the protective cover can be matched well to the corresponding sleeve.

The sleeve preferably comprises at least two sleeve segments which are arranged movable relative to one another for a change of the length.

The sleeve segments are preferably arranged displaceable with respect to one another with reference to a direction substantially in parallel to the dispensing direction. The sleeve segments can in particular be pushed into one another. Such an arrangement is also referred to as a boxed sleeve.

The design of the sleeve having at least two sleeve segments which can be moved with respect to one another and/or can be displaced has the advantage that the sleeve can be produced simply and more cost-effectively and can be matched well to the different requirements with respect to the use of the cartridge and/or of the dispensing apparatus, for example by a selection of the size and/or of the number of the sleeve segments.

The at least two sleeve segments are preferably coupled to one another in such a way that the sleeve segments can be displaced with respect to one another by at most the shorter of the segment lengths of the at least two sleeve segments with reference to a movement substantially opposite to the dispensing direction, in particular starting from the shortest possible length of the sleeve on a correct use of the sleeve.

This configuration has the advantage that the sleeve segments do not have to be moved so far relative to one another such that support can no longer be ensured by the sleeve. The coupling can, for example, take place through a locking of the sleeve segments to one another with reference to a movement substantially opposite to the dispensing direction. The sleeve segments preferably have hooks arranged such that adjacent sleeve segments can be coupled to one another and can be displaced relative to one another, wherein the hooks are in particular configured as projections arranged substantially perpendicular to the dispensing direction, wherein the hooks are preferably formed in one piece with the sleeve segments. Alternatively, additional coupling elements, such as tracks, frames or coupling transmissions can naturally be provided.

A segment transition region from a sleeve segment to an adjacent sleeve segment preferably has a curvature and/or a chamfer at the side facing the cartridge such that a damaging of the cartridge wall can substantially be avoided on dispensing.

This has the advantage in particular on the use of thin walled cartridges possibly produced by a thermo forming process or a blow molding process that the cartridge wall is subjected to very high loads, in particular due to the movement of the sleeve segment in the segment transition region.

A curvature and/or a chamfer of the segment transition region in the sense of this application is in this connection understood such that edges are possibly formed by areal sections of the segment transition region which can be in contact with the cartridge on a correct use thereof, with the areal sections including an obtuse angle or a reflex angle. In this connection, the angle is determined between the aerial sections at the side facing the cartridge. Particularly, preferably the regions of the segment transition region which can be in contact with the cartridge on a correct use thereof are configured substantially continuous and differentiable. A substantially continuous and differentiable region in the sense of the application is understood such that the region has no kink points or jumps at which a derivation about the kink point to the right is not equal to a derivation to the left in a mathematical sense. In this sense, for example, the function $f(x)=|x|$ is not differentiable at the position $x=0$.

A protective device is preferably arranged in at least one segment transition region and preferably in all segment transition regions at the side facing the cartridge. The protective device is in particular configured as a ring which is preferably flexible or elastic.

This configuration has the advantage that the probability of damaging of the cartridge can be significantly reduced in the segment transition regions during the dispensing.

A sleeve segment is preferably produced from a plastic. The sleeve is in particular produced from plastic. For example, fiber-glass reinforced plastics or carbon fiber reinforced plastics or arbitrary mixtures thereof can be used.

This configuration has the advantage that the sleeve can be produced more cost-effectively and can possibly be configured as a disposable part.

A sleeve segment is preferably formed from a metal. The sleeve is in particular formed from a metal. For example, aluminum, steel or metal alloys can be used.

This configuration has the advantage that an increased longevity of the sleeve segment or possibly of the sleeve can be achieved which amongst other things reduces waste material.

The sleeve preferably expands in the dispensing direction. The sleeve in particular expands conically and is preferably configured as a truncated cone. This configuration has the advantage of an improved controllable collapsibility of the cartridge.

A further aspect of the present invention relates to a dispensing apparatus comprising a support cartridge for the reception of the cartridge. The dispensing apparatus further comprises a sleeve as described above.

The sleeve is preferably releasably connectable at and/or in the support cartridge. This configuration has the advantage that the sleeve can be exchanged in dependence on the cartridge used. Moreover, it is possible to exchange a possibly damaged sleeve without having to exchange the dispensing apparatus.

The sleeve can preferably be coupled and/or decoupled to a dispensing plunger in particular for the reversible change of the length of the sleeve. This has the ad-vantage that the sleeve can be brought into a start position in a simple manner for an operator for inserting a new cartridge into the dispensing apparatus.

A further aspect of the present invention relates to a method for the dispensing of a medium from a collapsible cartridge by a dispensing apparatus. The dispensing apparatus is in particular configured as described above. The method comprises the step of providing the dispensing apparatus having a support cartridge for receiving the cartridge. The dispensing apparatus further has a dispensing plunger. A sleeve is fastened, in particular releasably fastened at and/or in the support cartridge, wherein the cartridge and the sleeve are arranged with respect to one another in such a way that the sleeve supports a cartridge wall of the cartridge in at least one section thereof during a dispensing of the medium. A length of the sleeve can be changed substantially in parallel to a dispensing direction.

Subsequently, the step of dispensing the medium out of the collapsible cartridge takes place by means of the dispensing apparatus by moving the dispensing plunger along the dispensing direction to an outlet side. During the movement of the dispensing plunger the length of the sleeve is reduced, with the cartridge wall being supported at least in one section thereof by the sleeve.

BRIEF DESCRIPTION OF THE DRAWINGS

The invention will be explained in more detail hereinafter with reference to the drawings.

DETAILED DESCRIPTION OF THE EMBODIMENTS

Figure 1:
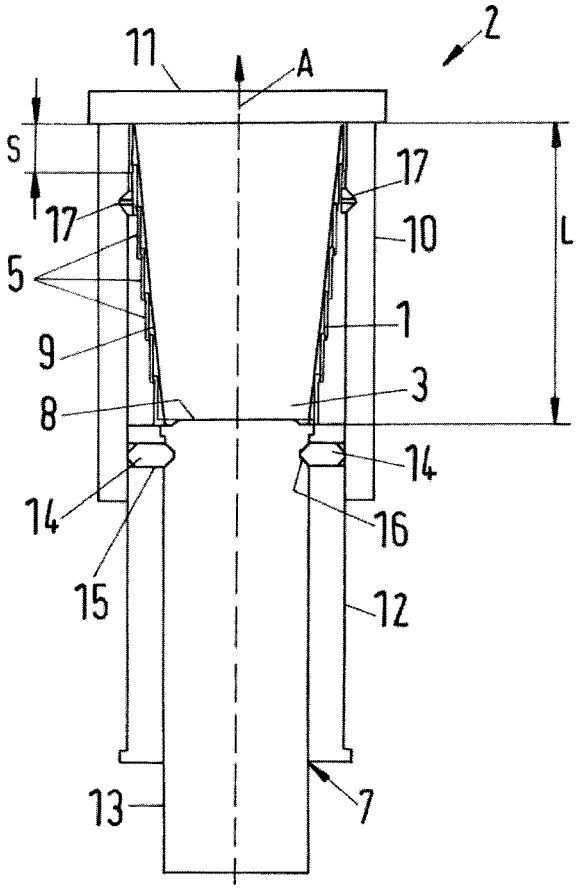
FIG. 1 is a schematic illustration of a dispensing apparatus in accordance with the invention.

FIG. 1 shows a dispensing apparatus 2 in accordance with the invention in a schematic illustration.

The dispensing apparatus 2 in accordance with FIG. 1 is present in a start position prior to the dispensing of a medium from a collapsible cartridge 3 which is arranged in the dispensing apparatus 2. The dispensing apparatus 2 comprises a support cartridge 10 for the reception of the cartridge 3 which conically expands in the dispensing direction A and in the present case forms a truncated cone.

A dispensing plunger 7 is partly arranged in the support cartridge 10, wherein the dispensing plunger 7 can act on the cartridge 3 by an end face through a movement of the dispensing plunger 7 along the dispensing direction A.

A sleeve 1 is arranged in a support cartridge 10 which surrounds the cartridge to support the cartridge wall 9 at least during the dispensing such that the cartridge 3 does not burst by the pressure exerted on the cartridge 3 for dispensing.

The sleeve 1 comprises a plurality of sleeve segments 5 which can be displaced with respect to one another with reference to the dispensing direction A and which has a length L. In this connection, the sleeve segments 5 are configured such that they can be pushed into one another in such a way that the collapsible cartridge 3 can be compressed for a dispensing of the medium.

The sleeve segments 5 have a segment length S. The sleeve segments 5 are coupled to one another in such a way that the sleeve segments 5 can be displaced relative to one another by the smaller of the segment lengths S of the at least two sleeve segments 5 with reference to a movement substantially opposite to the dispensing direction A.

The dispensing plunger 7 is of two-part design and comprises a first plunger 12 and a second plunger 13. The second plunger 13 is arranged in the first plunger 12.

Pins 14 are arranged in the openings 15 and the depression 16 for coupling and/or decoupling the plunger. Moreover, recesses 17 are arranged in the support cartridge 10. The pins 14 can be moved into the recesses 15 in a decoupling position. In this case the pins no longer engage into the depression 16 so that a decoupling of the plunger can take place, whereby a residual volume of the medium in the cartridge 3 can be minimized following the dispensing through an outlet (not shown) arranged in the outlet side 11. A static or dynamic mixing device can be arranged at the outlet side in accordance with the requirements, when, for example, the cartridge 3 includes at least two different components to be mixed as a medium. A feed tube can also alternatively or additionally be arranged for feeding the medium to a position of application.

Figure 2:
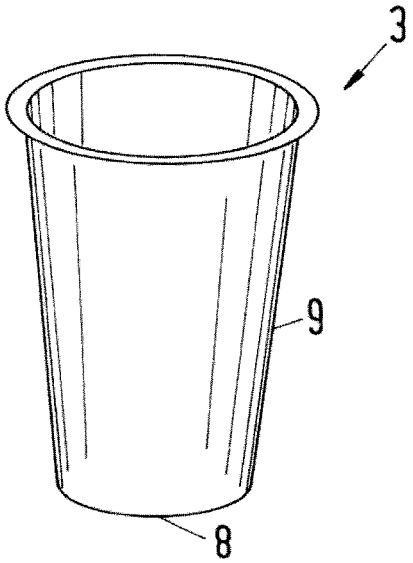
FIG. 2 is a perspective illustration of a cartridge for use in a dispensing apparatus in accordance with FIG. 1.

A collapsible cartridge 3 such as can be used in the dispensing apparatus in accordance with FIG. 1 is shown in a perspective illustration in FIG. 2. The cartridge 3 has a cartridge base 8 and a cartridge wall 9.

The same reference numerals relate to the same features in all of the Figures.

Figure 3:
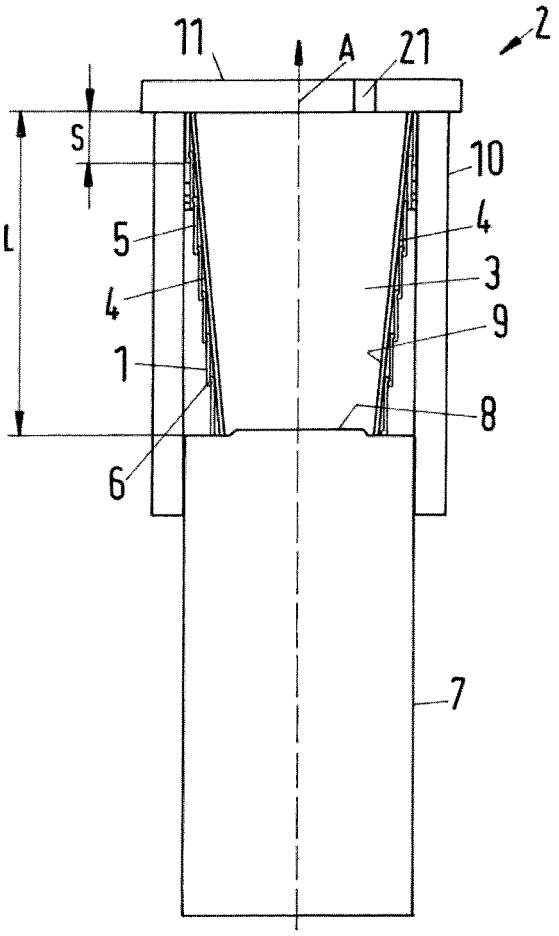
FIG. 3 is a schematic illustration of an alternative dispensing apparatus in accordance with the invention.

An alternative dispensing apparatus in accordance with the invention is schematically illustrated in FIG. 3. The sleeve segments 5 of the sleeve 1 are made of plastic.

In contrast to FIG. 1 a protective film 4 configured as a protective cover is arranged between the collapsible cartridge 3 and the sleeve 1. In the present case the protective cover moreover has the function of a protective device for the cartridge 3 such that the cartridge 3 can be protected better from damages, in particular in the segment transition regions 6. For this purpose the protective film 4 is reversibly elastic.

The dispensing plunger 7 is of one-part design in contrast to the two-part dispensing plunger decouplable in accordance with FIG. 1. An outlet 21 is arranged in the outlet side 11 for a dispensing of the medium from the cartridge 3.

Figure 4A:
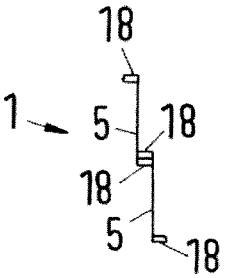
FIG. 4A-4C are schematic illustrations of sleeve segments in different positions with respect to one another.
Figure 4B:
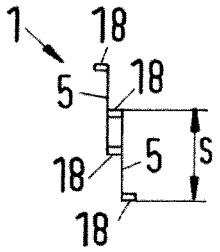
Figure 4C:
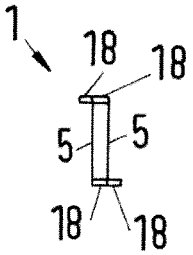

Two sleeve segments 5 in different relative positions with respect to one another are respectively schematically illustrated by way of sections in the—FIGS. 4A-4C. These sleeve segments 5 can be used, for example, for the formation of the sleeves such as they are shown in the FIG. 1 and FIG. 3. The sleeves in accordance with FIG. 3, for example, comprise seven such sleeve segments for the formation of the sleeve.

The sleeve segments 5 have projections 18 for hooking the sleeve segments 5 to one another such that the sleeve segments 5 can be displaced relative to one another by at most the shortest of the segment lengths S of the two sleeve segments 5 with reference to a movement substantially opposite to the dispensing direction A. Since the sleeve segments 5 all have the same segment length S in the present example these can be displaced opposite to the dispensing apparatus A by at most the segment length S, starting from the shortest possible length L of the sleeve in the dispensing direction.

The relative arrangement of the sleeve segments 5 in accordance with FIG. 1 and FIG. 3 is illustrated in a starting position in FIG. 4A. An intermediate position of the sleeve segments 5 with respect to one another is shown in FIG. 4B and a final position following the dispensing is shown in FIG. 4C in accordance with FIG. 6.

Figure 5:
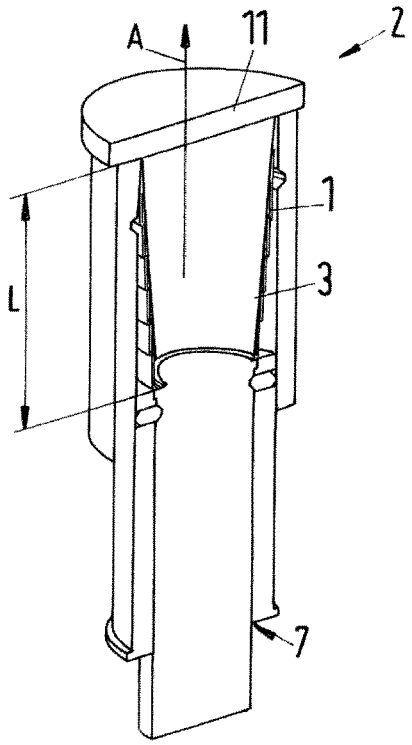
FIG. 5 is a perspective illustration of the dispensing apparatus in accordance with FIG. 1 in a first position.

The dispensing apparatus 2 in accordance with the invention according to FIG. 1 is shown in a starting position in a perspective illustrate in FIG. 5. The dispensing apparatus 2 in accordance with the invention according to FIG. 1 is illustrated in a final position in a perspective illustration in FIG. 6. The length L of the sleeve 1 in accordance with FIG. 5 in this connection is larger than the length L of the sleeve 1 in accordance with FIG. 6. The sleeve segments 5 were displaced relative to one another during the dispensing of the medium from the collapsible cartridge 3 such that the length L of the sleeve 1 was reduced.

Figure 6:
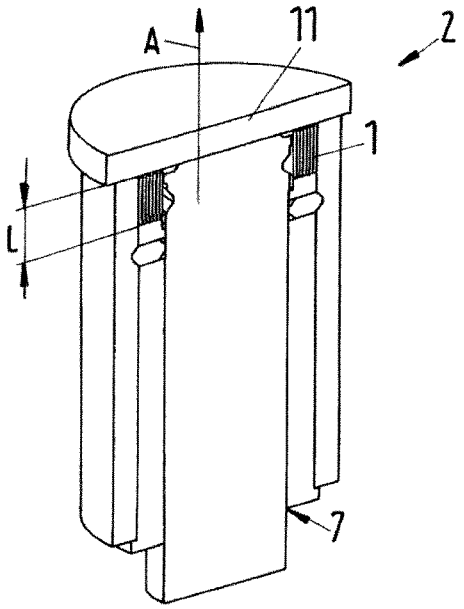
FIG. 6 is a perspective illustration of the dispensing apparatus in accordance with FIG. 1 in a second position.

The length L of the sleeve in accordance with FIG. 6 substantially corresponds to the segment length S in accordance with FIG. 1.

Figure 7A:
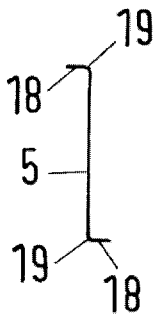
FIG. 7A-7B are schematic illustrations of alternative sleeve segments in accordance with the invention having curvatures and chamfers.
Figure 7B:
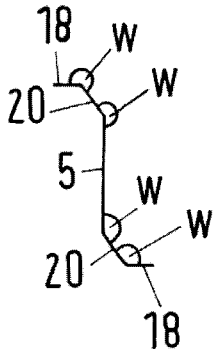

Sleeve segments having curves 19 and chamfers 20 in accordance with the invention are illustrated in the—FIG. 7A and FIG. 7B. The sleeve segment 5 in accordance with FIG. 7A has curves 19 at the side facing the cartridge in the segment transition regions, the curves being formed continuous. The sleeve segment 5 in accordance with FIG. 7B has chamfers 20 in these segment transition regions, wherein the aerial sections of the sleeve segment having the chamfer 20 form an obtuse angle or a relaxed angle W respectively.

Figure 8:
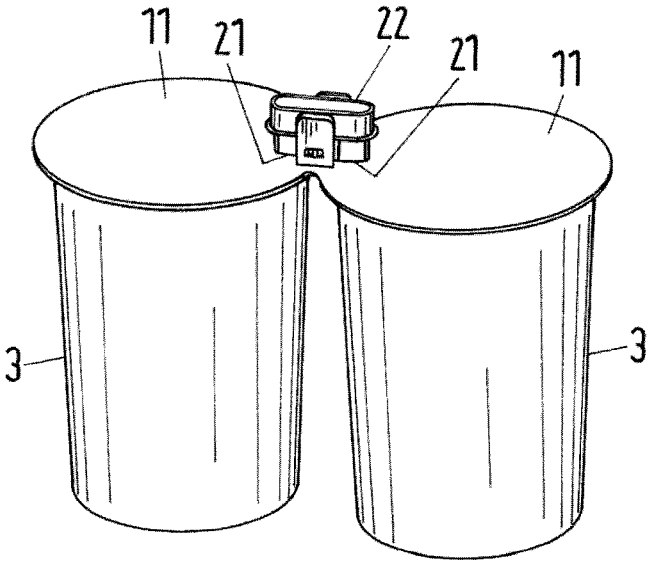
FIG. 8 is a perspective illustration of two cartridges for a dispensing apparatus.
Figure 9:
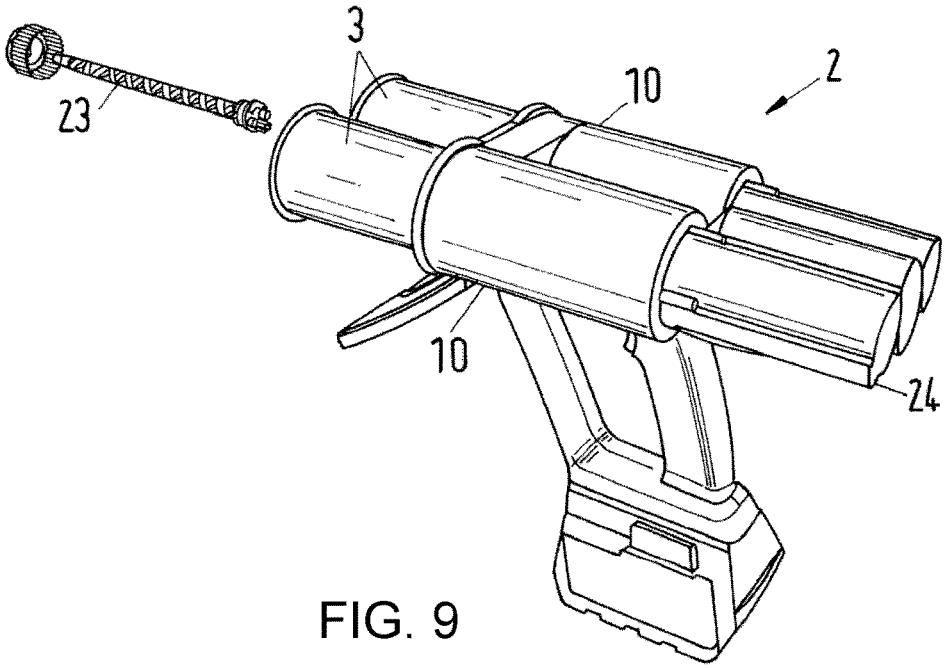
FIG. 9 is a perspective illustration of a dispensing apparatus for the two cartridges in accordance with FIG. 8.

Two cartridges 3 are illustrated in FIG. 8 in a perspective illustration for the reception in a dispensing apparatus in accordance with FIG. 9.

The cartridges 3 have outlets 21 which are arranged at the outlet side 11. Moreover, a fastening apparatus 22, for example for a static mixer is provided. Naturally also other application apparatuses, such as for example cannulas, can be arranged at the fastening apparatus 21.

Typically the two cartridges include two different adhesive components which can be mixed by a static mixer arranged downstream of the outlet 21 at the fastening apparatus 22.

In the present case the two cartridges 3 have an equal reception volume for the two components. Naturally, it is also plausible to use cartridges with different reception volumes in accordance with the requirements and the dispensing apparatus used.

A dispensing apparatus 2 in accordance with the invention is shown in a perspective illustration in FIG. 9.

The dispensing apparatus 2 has a support cartridge 10 designed for the reception of the two cartridges 3. The dispensing apparatus 2 further comprises a static mixer 23 which can be fastened at the fastening apparatus 22 illustrated in the FIG. 8.

The dispensing apparatus 2 further comprises a drive 24 comprising an electromotor for actuating the dispensing plunger which is not visible in this example. The dispensing apparatus 2 comprises two dispensing plungers for the substantially simultaneous dispensing of the two cartridges 3.

The dispensing plungers can be configured as shown in FIG. 1 or FIG. 3 in this connection.

What is claimed is:

1. A sleeve for a dispensing apparatus for reception of a collapsible cartridge including a dispensable medium, the sleeve configured to be arranged with respect to the collapsible cartridge such that the sleeve supports a cartridge wall of the collapsible cartridge in at least one section thereof during dispensing of the medium, a length of the sleeve capable of being changed substantially in parallel to a dispensing direction, and the sleeve being configured to expand in the dispensing direction, the sleeve comprising at least two sleeve segments which are movably arranged relative to one another so as to affect a change of the length.

2. The sleeve in accordance with claim 1, wherein the length is capable of being reversibly changed.

3. The sleeve in accordance with claim 1, further comprising a protective cover arranged at a side of the sleeve facing the collapsible cartridge, the protective cover being arranged at least in a section between the sleeve and the cartridge.

4. The sleeve in accordance with claim 3, wherein the protective cover is removably arranged.

5. The sleeve in accordance with claim 1, wherein the sleeve segments are displaceable with respect to one another in a direction substantially parallel to the dispensing direction.

6. The sleeve in accordance with claim 1, wherein each of the at least two sleeve segments has a length, and the at least two sleeve segments are coupled to one another such that the sleeve segments are displaceable relative to one another by at most a smaller length of the segment lengths of the at least two sleeve segments relative to movement substantially opposite to the dispensing direction.

7. The sleeve in accordance with claim 1, further comprising a plurality of segment transition regions, one of the segment transition regions from a sleeve segment to an adjacent sleeve segment at a side facing the collapsible cartridge having a curvature or chamfer such that damaging of the cartridge wall is substantially avoided during dispensing.

8. The sleeve in accordance with claim 7, further comprising a protective device arranged in the at least one segment transition region at the side facing the collapsible cartridge.

9. The sleeve in accordance with claim 1, wherein at least one sleeve segment of the at least two sleeve segments is made of a plastic.

10. The sleeve in accordance with claim 1, wherein the sleeve is configured to conically expand in the dispensing direction.

11. A dispensing apparatus, comprising:

a support cartridge configured to receive a collapsible cartridge; and a sleeve configured to receive the collapsible cartridge including a dispensable medium, the collapsible cartridge and the sleeve configured to be arranged with respect to one another such that the sleeve is capable of supporting a cartridge wall of the collapsible cartridge in at least one section thereof while dispensing the medium, a length of the sleeve capable of being changed substantially parallel to a dispensing direction, and the sleeve being configured to expand in the dispensing direction, the sleeve being capable of being coupled or decoupled to a dispensing plunger.

12. The dispensing apparatus in accordance with claim 11, wherein the sleeve is capable of being releasably attached at or in the support cartridge.

13. A method for dispensing a medium out of a collapsible cartridge, comprising:

providing a dispensing apparatus comprising a support cartridge for receiving the collapsible cartridge and a dispensing plunger, and a sleeve for the receiving the collapsible cartridge including a dispensable medium fastened at or in the support cartridge, the collapsible cartridge and the sleeve are arranged with respect to one another such that the sleeve supports a cartridge wall of the collapsible cartridge in at least one section thereof during dispensing of the medium, and a length of the sleeve is capable of being changed substantially in parallel to a dispensing direction, the sleeve being configured to expand in the dispensing direction; and dispensing the medium out of the collapsible cartridge by moving the dispensing plunger of the dispensing apparatus along the dispensing direction to an outlet side, while reducing the length of the sleeve during movement of the dispensing plunger, and the cartridge wall of the collapsible cartridge being supported by the sleeve in at least a section thereof.

14. The sleeve in accordance with claim 3, wherein the protective cover is a protective film.

15. The sleeve in accordance with claim 8, wherein the protective device is arranged in each and every segment transition region at the side facing the collapsible cartridge.

16. The sleeve in accordance with claim 8, wherein the protective device is a ring.

17. The sleeve in accordance in claim 16, wherein the ring is flexible or elastic.

18. The sleeve in accordance with claim 9, wherein the sleeve is plastic.

19. The dispensing apparatus in accordance with claim 11, wherein the sleeve is configured to be coupled or decoupled to the dispensing plunger such that the length of the sleeve is capable of being reversible changed.

20. A sleeve for a dispensing apparatus for reception of a collapsible cartridge including a dispensable medium, the sleeve configured to be arranged with respect to the collapsible cartridge such that the sleeve supports a cartridge wall of the collapsible cartridge in at least one section thereof during dispensing of the medium, a length of the sleeve capable of being changed substantially in parallel to a dispensing direction, and the sleeve being configured to expand in the dispensing direction, and a protective cover arranged at a side of the sleeve facing the collapsible cartridge, the protective cover being arranged at least in a section between the sleeve and the cartridge.

* * * * *